US005304030A

United States Patent [19]

Neri

[11] Patent Number: 5,304,030

[45] Date of Patent: Apr. 19, 1994

[54] DEVICE FOR THE AUTOMATIC FEEDING OF STACKS OF CUTOUTS TO A USER MACHINE

[75] Inventor: Armando Neri, Bologna, Italy

[73] Assignee: G.D. S.p.A., Bologna, Italy

[21] Appl. No.: 756,704

[22] Filed: Sep. 9, 1991

[30] Foreign Application Priority Data

Sep. 11, 1990 [IT] Italy ..... 3649 A/90

[51] Int. Cl.[5] ..... B65H 1/22

[52] U.S. Cl. ..... 414/795.8; 414/793.4; 414/609; 414/743; 198/409

[58] Field of Search ..... 414/793.4, 795.8, 609, 414/728, 742, 743; 198/409, 457

[56] References Cited

U.S. PATENT DOCUMENTS

| | | | |
|---|---|---|---|
| T999,001 | 10/1980 | Bevan | 414/793.4 |
| 1,980,261 | 11/1934 | Fenton | 198/457 |
| 3,953,021 | 4/1976 | Seragnoli . | |
| 4,285,621 | 8/1981 | Spencer . | |
| 4,382,743 | 5/1983 | Newell | 414/728 |
| 4,526,501 | 7/1985 | Blumle | 414/793.4 |
| 4,553,899 | 11/1985 | Magni | 414/728 |
| 4,618,054 | 10/1986 | Muller | 198/409 |
| 4,666,030 | 5/1987 | Okada | 198/457 |
| 4,907,941 | 3/1990 | Focke | 414/795.8 |
| 4,919,589 | 4/1990 | Krappitz | 414/416 |
| 5,144,789 | 9/1992 | Focke | 414/412 |

FOREIGN PATENT DOCUMENTS

| | | | |
|---|---|---|---|
| 0037099 | 10/1981 | European Pat. Off. . | |
| 0888674 | 9/1953 | Fed. Rep. of Germany . | |
| 2064295 | 7/1972 | Fed. Rep. of Germany . | |
| 2258873 | 6/1974 | Fed. Rep. of Germany | 414/609 |
| 3307675 | 10/1987 | Fed. Rep. of Germany . | |
| 874537 | 10/1981 | U.S.S.R. | 414/793.4 |

*Primary Examiner*—Michael S. Huppert
*Assistant Examiner*—Gregory A. Morse
*Attorney, Agent, or Firm*—Guido Modiano; Albert Josif

[57] ABSTRACT

The device for the automatic feeding of cutouts to a user machine, includes an inclined supporting plate for receiving, in succession, stacks of cutouts input to the user machine. A fixed guide is arranged above the supporting plate and a motorized trolley is slidably movable, on the guide, from and toward an output end of a conveyor of stacks of cutouts. An L-shaped element defining a support element is pivotally connected to a rod which extends down from the trolley, and the support element is arrangeable, at the output end, parallel to the advancement direction of the conveyor, and at an unloading station, parallel to the supporting plate. A stop device, defining two spaced uprights, extending from the supporting plate, is arranged at the unloading station, and the space between the uprights allows free passage of the L-shaped element while the stacks of cutouts rest against the uprights.

11 Claims, 2 Drawing Sheets

DEVICE FOR THE AUTOMATIC FEEDING OF STACKS OF CUTOUTS TO A USER MACHINE

BACKGROUND OF THE INVENTION

The present invention relates to a device for the automatic feeding of stacks of cutouts to a user machine.

In particular, the present invention relates to a device suitable for automatically feeding stacks of cutouts to a packaging machine.

SUMMARY OF THE INVENTION

The aim of the present invention is to eliminate, in the simplest and most economical possible manner, the imperfections and time losses which generally arise from a manual feeding of said cutouts to said user machine, and the labor used for this purpose.

According to the present invention, a device for the automatic feeding of cutouts to a user machine is provided. The device comprises a supporting plate which can be mounted in a fixed position at an input station of said user machine; and an unloading station which is arranged on said supporting plate and is suitable for receiving in succession stacks of cutouts input to said user machine, characterized in that it furthermore comprises a guide which extends above the supporting plate; a motorized trolley which is slidingly mounted on the guide for conveying the stacks of cutouts; a conveyor of stacks of cutouts; and means for loading said stacks onto the conveyor; said conveyor having an output end directed toward the supporting plate, said trolley being movable above said supporting plate from and toward said output end and through the unloading station; said unloading station comprising stop means for said stacks, said stop means being arranged along the path of the trolley above the supporting plate, said trolley being able to pass through said stop means.

Preferably, in the above defined device, the guide extends parallel to the supporting plate and at a preset distance from said plate; the trolley comprises an element for supporting one of said stacks, and said supporting element is open at least toward the output end of said conveyor.

Said guide furthermore has a first axis which is coplanar with a direction of advancement of the stacks along the conveyor; said first axis and said advancement direction form an angle between them, and said supporting element is coupled to the guide so as to rotate with respect to said guide, about a second axis which is parallel to the supporting plate and is perpendicular to the first axis, between a first position which is parallel to the supporting plate and a second position which is parallel to said advancement direction.

BRIEF DESCRIPTION OF THE DRAWINGS

The invention is now described with reference to the accompanying drawings, which illustrate some non-limitative embodiments thereof, wherein.

DESCRIPTION OF THE PREFERRED EMBODIMENTS

Figure 1:
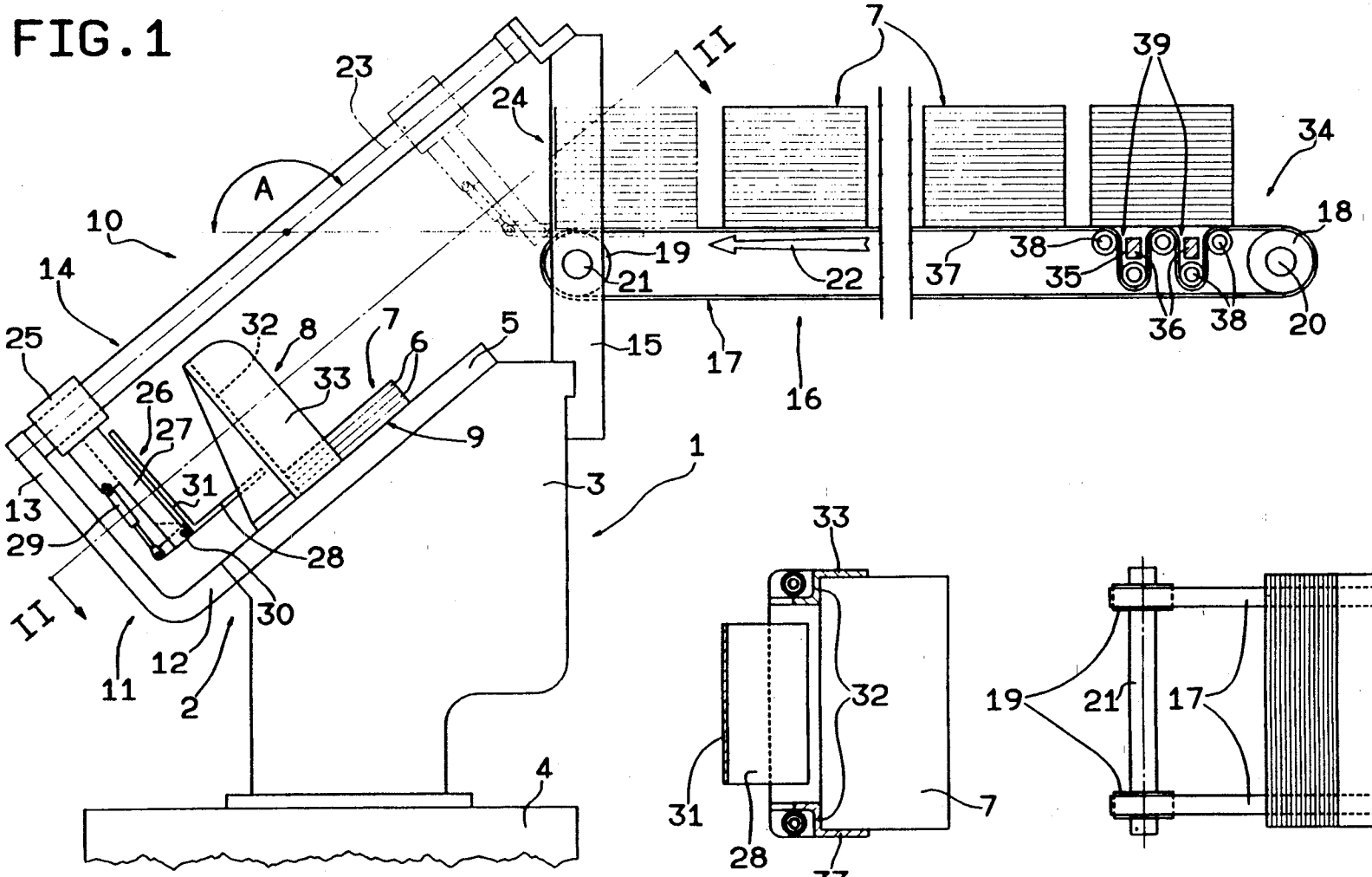
FIG. 1 is a lateral elevation view of a preferred embodiment of the device according to the present invention.
Figure 2:
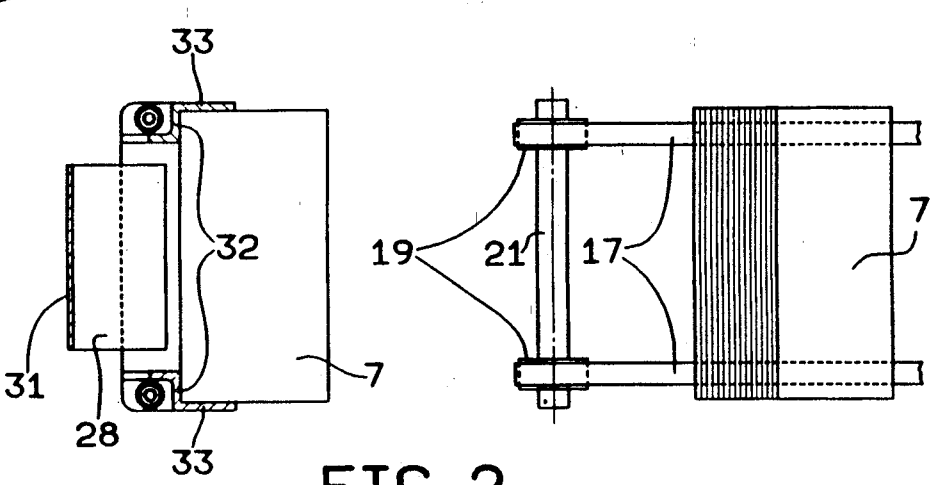
FIG. 2 is a sectional view, taken along the line II—II of FIG. 1.

With reference to FIGS. 1 and 2, the reference numeral 1 generally indicates a packaging machine which comprises an input station 2, defined by a housing 3 which is supported by a base 4 and is limited upward by an inclined supporting plate 5 in which an opening constituting an input station is defined in a manner which is known and not illustrated; cutouts 6 are removed in succession, through said opening, by means of a device which is known and not illustrated and is accommodated inside the housing 3, from the bottom of a stack 7 which is arranged above the plate 5 in contact with a tower-like stop device 8 and at a station 9 which is indicated hereinafter by the term "unloading station" or "delivery station" defining an unloading plane parallel to said supporting plate 5.

The plate 5 and the stop device 8 constitute a part of an automatic device, generally indicated by the reference numeral 10, for feeding cutouts 6 to the machine 1.

The device 10 comprises a substantially L-shaped bracket 11, a first arm 12 of which is rigidly associated with the lower end of the plate 5 and is co-planar to said plate 5, whereas a second arm 13 of said bracket extends upward from the end of the first arm 12 which is opposite to the one connected to the plate 5 in a direction which is perpendicular to said plate 5. The lower end of a guide 14 is rigidly connected to the upper end of the arm 13 and extends upward in a position which is parallel to, and above, the upper surface of the plate 5, and is connected, at its own upper end, to the end of an upright 15 which extends vertically upward from the housing 3 in a position which is generally located in the same elevational plane as the upper end of the plate 5.

The output end of a conveyor, generally indicated by the reference numeral 16, is connected, in a manner which is known and not illustrated, to an intermediate point of the upright 15 which is arranged above the upper end of the plate 5; said conveyor, the output end of which defines loading or take-up station and a loading plane, comprises, as more clearly illustrated in FIG. 2, two belts 17 which are arranged parallel to one another and at a preset distance from one another, in a substantially horizontal plane. The belts 17 are wound in a loop around respective input and output pulleys 18 and 19 which are keyed on respective shafts 20 and 21, one of which is motorized, which extend on a substantially horizontal plane so as to cause the belts 17 to advance stepwise toward the plate 5 and along a direction of advancement indicated by an arrow 22 which intersects an axis 23 of the guide 14 and forms an angle A with said axis 23 and with the plane of arrangement of the plate 5.

Above the conveyor 16 there is an orderly succession of stacks 7, one of which is caused to advance, at each advancement step of the belts 17, at an output station 24 which is arranged above the shaft 21.

The suspension sleeve 25 of a stack transfer means in the form of a trolley, which is generally indicated by the reference numeral 26 and comprises a carrying mechanism comprising a rod 27 which extends radially outward from the sleeve 25 in a direction which is perpendicular to the plate 5 and toward said plate 5, is slidingly mounted along the guide 14. A planar supporting element 28 defining a supporting surface area of a take-up member is arranged at a preset elevational distance from said plate 5; said supporting element 28 is pivoted so as to be suitable for rotating, with respect to the rod 27 and under the thrust of an actuator 29, about an axis 30 which is parallel to the plate 5 and perpendicular to the axis 23, between a conveyance position which is parallel to the plate 5 and a loading position which is parallel to the arrow 22. It will be understood that thereby the mutual position between the supporting element 28 and the rod 27 of the carrying mechanism 25, 27 is adjustable by means of the actuator 29.

The planar element 28 extends from the axis 30 toward the conveyor 16 and is narrower than the space between the belts 17. On the side directed toward said axis 30, a rib 31 defining a backing surface is perpendicularly connected to the element 28 and extends along the rod 27 so as to form, with said element 2B, an L-shaped structure which is open toward the conveyor 16.

According to what is illustrated in FIG. 2, the stop device 8 which defines stacks receiving means, comprises two uprights 32 which are rigidly associated with the plate 5 and extend from said plate 5 toward the guide 14. The uprights 32 are arranged in a plane which is perpendicular to the guide 14; each upright extends toward the other from a related supporting plate 33 which is perpendicular to the plate 5, and the uprights 32 are arranged at a mutual distance from each other which is smaller than a dimension of the stacks 7, measured in a direction parallel to the plate 5 and perpendicular to the guide axis 23.

The device 10 finally comprises a loading device 34 which in turn comprises a fork-like element 35, the arms 36 whereof can move in a direction which is perpendicular to the arrow 22 and directly below a conveyance plane defined by the upper portions 37 of the belts 17. In order to be able to accommodate the arms 36, each of the portions 37 is diverted by a plurality of diversion rollers 38 so as to define, below said conveyance plane, two transverse grooves 39, each of which can be engaged by a respective arm 36.

In use, the stacks 7 are fed in succession by the loading device 34 above the conveyor 16, which feeds them stepwise toward the loading station defined by the conveyor's output end 24, from which said stacks 7 are removed in succession by means of the trolley 26 in order to be fed to the unloading station 9. For this purpose, the trolley 26 is moved toward the station 24 along the guide 14, with its own element 28 arranged in its conveyance position. When the element 28 reaches the output end of the conveyor 16, the actuator 29 is actuated so as to rotate said element 28 about the axis 30 between said conveyance angular position which is parallel to the plate 5 and said removal or loading or take-up angular position which is parallel to the arrow 22. The trolley 26 is inserted in the station 24 with the element 28 arranged in its removal position, so as to engage the space between the belts 17 and arrange itself below the stack 7 arranged in said station 24. At this point, the actuator 29 is actuated so as to return the element 28 to its conveyance position and raise said stack 7 from the conveyor 16. The trolley 26 is then actuated again so as to move the stack 7 into the unloading station 9, at which said stack 7 is unloaded onto the plate 5 due to its contrast with the uprights 32.

Once said stack 7 has been abandoned, the trolley 26 continues past the unloading station 9, passing between the uprights 32, and stops in a stroke limit position above a lower terminal portion of the plate 5.

When the height of the stack 7 arranged on the plate 5 at the station 9 decreases below a preset value which is lower than said preset distance between the element 28 and the plate 5, a sensor (not illustrated) causes the actuation of the trolley 26 and the movement of said trolley toward the conveyor 16 and above the upper end of said stack 7 which is being depleted, so as to start a cycle for feeding a new stack 7 to the unloading station 9. Said new stack 7 is naturally fed by the trolley 26 above the upper end of the stack 7 which is being depleted.

Figure 3:
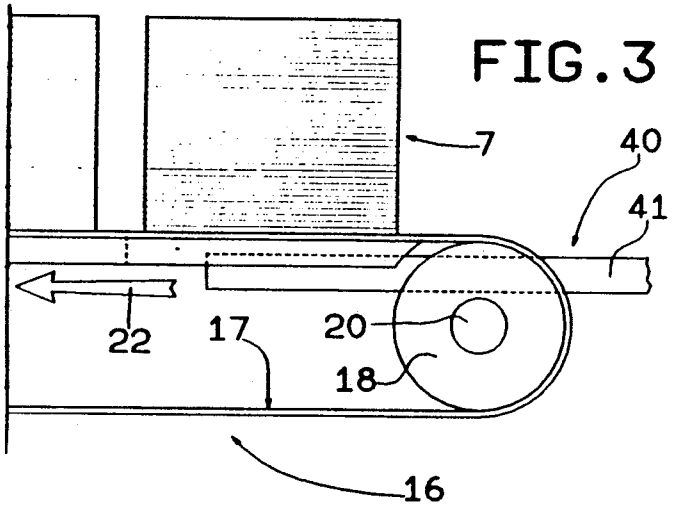
FIG. 3 is an enlarged-scale lateral elevation view of a variated embodiment of a detail of FIG. 1.

According to the embodiment illustrated in FIG. 3, the loading device 34 is replaced by a loading device 40 which comprises a fork-like element 41 which is suitable for moving parallel to the arrow 22 so as to insert itself between the belts 17 above the shaft 20.

Figure 5:
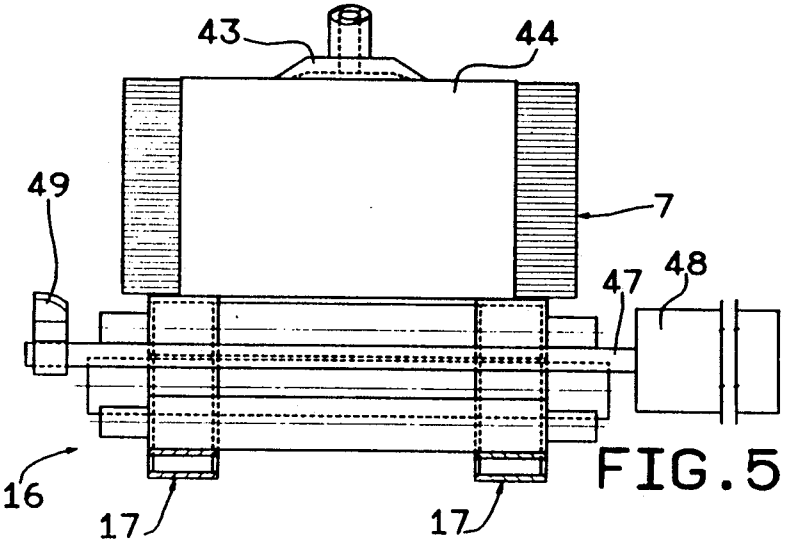
FIG. 5 is an end elevation view of the detail of FIG. 4.
Figure 6:
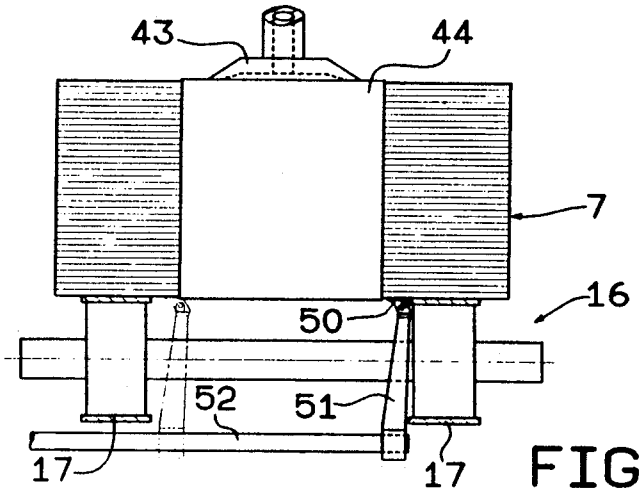
FIG. 6 is a view, similar to FIG. 5, of another embodiment of a detail of said FIG. 5.
Figure 4:
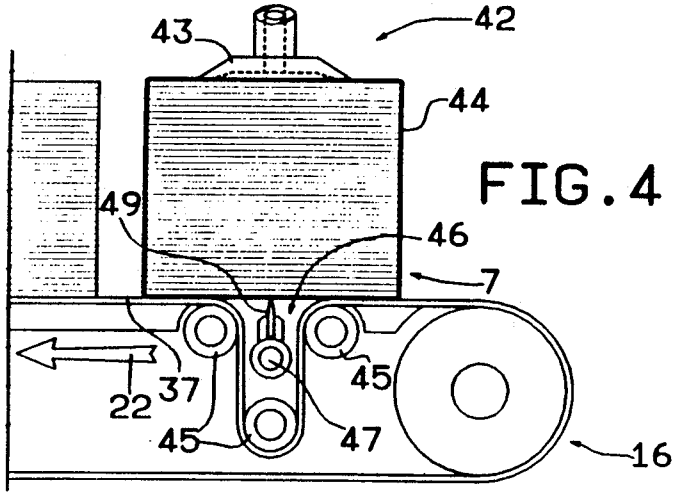
FIG. 4 is an enlarged-scale lateral elevation view of a further variated embodiment of a detail of FIG. 1.

According to the variated embodiments of FIGS. 4, 5 and 6, the loading device 34 is instead replaced by a loading device 42 which comprises a sucker element 43 suitable for cooperating in succession with strips 44 which are wrapped around respective stacks 7 in order to raise said stacks 7 and arrange them on top of the conveyor 16.

In the case of the variated embodiment illustrated in FIGS. 4 and 5, each strip 44 is wrapped around a central portion of the related stack 7 and is at least as wide as the space between the belts 17. Each of the belt portions 37 is diverted by three rollers 45 so as to define, below said conveyance plane, a transverse groove 46 along which there extends an output rod 47 of an actuator 48 which is suitable for imparting to said rod 47 a back-and-forth motion along the groove 46. A blade 49 is connected to the free end of the rod 47 and, upon the actuation of the rod 47, is suitable for cutting a strip 44 of a stack 7 which is arranged on the conveyor 16 astride the groove 46 and for allowing the removal of the cut strip 44 by the sucker element 43.

In the case of the embodiment illustrated in FIG. 6, each strip 44 is wrapped around a central portion of the related stack 7 and is narrower than the space between the belts 17. In this case, the strip 44 is cut by means of a blade 50 which is mounted on the end of an arm 51 which is keyed on an actuation rod 52 which extends transversely to the arrow 22 and is arranged below the conveyor 16.

I claim:

1. Device for the automatic feeding of cutouts to a user machine, said device comprising a supporting plate, which can be mounted in a fixed position at an input station of said user machine, and an unloading station which is arranged on said supporting plate and is suitable for receiving, in succession, stacks of cutouts in input to said user machine, said device furthermore comprising a guide which extends above said supporting plate; a motorized trolley which is slidingly mounted on said guide for the conveyance of the stacks of cutouts; a conveyor for stacks of cutouts; and means for loading said stacks onto the conveyor; said conveyor having an output end directed toward said supporting plate, said trolley being movable above said supporting plate from and toward said output end and through said unloading station; said unloading station comprising stop means for said stacks, said stop means being arranged along the path of the trolley above the supporting plate, said trolley being able to pass through said stop means, wherein said guide extends parallel to the supporting plate and at a preset distance from said plate; said trolley comprising a supporting element for one of said stacks, said supporting element being open at least toward the output end of said conveyor and an wherein said guide defines a first axis and said conveyor defines an advancement direction of said stacks; said first axis and said advancement direction defining, between them, an angle, said supporting element being coupled to said guide so as to be able to rotate with respect to said guide, about a rotation axis which is parallel to said supporting plate and is perpendicular to said first axis, between a first position which is parallel to said supporting plate and a second position which is parallel to said advancement direction.

2. Device according to claim 1, wherein said conveyor comprises two conveyor belts arranged at a mutual distance which is greater than a width of said supporting element and is smaller than a dimension of said stacks measured in a direction parallel to said supporting plate and perpendicular to said first axis.

3. Device according to claim 1, wherein said stop means comprises two uprights which are rigidly associated with said supporting plate and extend from said supporting plate toward the guide; said two uprights being arranged in a plane which is perpendicular to said guide and at a mutual distance which is smaller than a dimension of said stacks measured in a direction parallel to said supporting plate and perpendicular to the first axis.

4. An apparatus for the automatic feeding of cutouts to a user machine, said device comprising a supporting plate on said user machine, conveyor means defining a loading plane and a loading station at one end thereof near said supporting plate of said user machine and, at said supporting plate at a distance from said conveyor means, an unloading station defining an unloading plane parallel to said supporting plate, said unloading plane being inclined with respect to said loading plane, said unloading station being arranged at an input station of said user machine, said unloading station having a stacks receiving tower structure for receiving stacks of cutouts for input to said user machine at said input station thereof, said device further comprising guide means, stack transfer means including a carrying mechanism movable along said guide means and carrying said stack transfer means for moving said stack transfer means above and at least in the reach of said unloading and said loading stations, thereby to transfer said stacks of cutouts from said loading station to said stacks receiving tower structure of said unloading station for input to said user machine, said guide means extending in a longitudinal direction above said user machine and parallel to said unloading plane, said transfer means having supporting means defining a supporting surface area with a selected width perpendicular to said longitudinal direction for supporting thereon said stacks of cutouts loaded thereon at said loading station and backing means defining a backing surface area for backing said stacks of cutouts supported on said supporting surface area, said supporting surface area extending transverse from said backing surface area in the direction towards said loading station to form thereby a take-up member for said stacks of cutouts, said supporting means and said backing means being adjustable with respect to said carrying mechanism, said transfer means comprising actuator means for adjusting the angle between said supporting means and the supporting surface area thereof and said carrying mechanism from a loading angular position in which said supporting surface area is parallel to said loading plane when said stacks of cutouts are loaded thereon to an unloading angular position in which said supporting surface area is parallel to said unloading plane when said stacks of cutouts are taken up by said transfer means and delivered to said stacks receiving tower structure of said unloading station.

5. Device according to claim 4, wherein said conveyor means comprises two conveyor belts arranged at a mutual distance which is greater than the width of said supporting surface area and is smaller than a dimension of said stacks measured in a direction parallel to said supporting plate and perpendicular to said longitudinal direction.

6. Device according to claim 4, wherein said tower structure comprise two uprights which are rigidly associated with said supporting plate and extend from said supporting plate toward the guide; said two uprights being arranged in a plane which is perpendicular to said guide and at a mutual distance which is smaller than a dimension of said stacks measured in a direction parallel to said supporting plate and perpendicular to said longitudinal direction.

7. Device according to claim 4, further comprising loading means having a movable fork-like element which can move transversely with respect to an advancement direction of said conveyor, said conveyor having a conveyance surface which is arranged, in use, in contact with said stacks, said conveyor including diversion rollers defining transverse groove means suitable for being engaged by said movable fork-like element.

8. Device according to claim 4, further comprising loading means and wherein said conveyor comprises two longitudinal conveyor belts wound in a loop said loading means comprising an element which can move in a direction which is parallel to an advancement direction of said belts and is suitable for engaging a space defined between said belts.

9. Device according to claim 4, further comprising loading means having sucker means and wherein each of said stacks of cutouts comprises a strip wrapped in a loop therearound, said sucker means cooperating from above with an outer surface said strip in order to feed said stack above said conveyor; cutting means being coupled to the conveyor in order to cut said strip and allow its removal by means of said sucker means.

10. Device according to claim 9, wherein said conveyor includes diversion rollers defining transverse groove means in said conveyor, said cutting means comprising a blade which can move within said groove means in order to cut said strip.

11. Device according to claim 9, wherein said conveyor comprises two conveyor belts which are arranged at a mutual distance which is greater than a width of said strips; said cutting means comprising a blade which is arranged between said two belts and is movable transversely to said belts.

* * * * *